United States Patent [19]

Radtke

[11] 4,381,825

[45] May 3, 1983

[54] DRILL BIT NOZZLE

[75] Inventor: Robert P. Radtke, Kingwood, Tex.

[73] Assignee: Strata Bit Corporation, Houston, Tex.

[21] Appl. No.: 296,811

[22] Filed: Aug. 27, 1981

[51] Int. Cl.[3] ..... E21B 10/60

[52] U.S. Cl. ..... 175/393

[58] Field of Search ..... 239/589, 600; 175/339, 175/340, 393; 411/403, 405; 285/355, 390, 392, 393

[56] References Cited

U.S. PATENT DOCUMENTS

| | | | |
|---|---|---|---|
| 2,397,367 | 3/1946 | Orzel | 285/393 X |
| 3,207,241 | 9/1965 | Neilson | 175/376 |
| 3,645,311 | 2/1972 | Maurer et al. | 175/393 |

FOREIGN PATENT DOCUMENTS

| | | | |
|---|---|---|---|
| 1025766 | 1/1953 | France | 411/405 |

*Primary Examiner*—Stephen J. Novosad
*Assistant Examiner*—Joseph Falk
*Attorney, Agent, or Firm*—Neal J. Mosely

[57] ABSTRACT

A drill bit for connection on a drill string has a hollow tubular body with an end cutting face and an exterior peripheral stabilizer surface with cylindrical sintered carbide inserts positioned therein and a novel arrangement for securing replaceable nozzles. Nozzle passages extend from the interior of the bit body through the cutting face for receiving a removable and interchangeable nozzle member therein. A portion of the length of each passage is threaded and the remainder of the passage is enlarged and of a smooth bore. The nozzle member is formed of wear-resistant hard metal, e.g. carbide, and has a metal sleeve brazed thereon with male threads operable to be fitted in the threads in said nozzle passage. The nozzle member is threadedly secured in place during installation and optionally further secured against unscrewing and additionally protected against wear or erosion by a metal or hard metal, e.g. carbide, retaining ring having an interference fit in the smooth portion of the nozzle passage. The shape of the hard metal nozzle member protects the entire nozzle assembly, and particularly the threaded metal sleeve, from erosion produced by abrasive drilling fluids. The cutting face supports suitable cutting means, preferably diamond cutting elements. The replaceable nozzles with threaded exteriors and protecting retaining rings may be used with other types of drill bits, e.g. roller cone bits, but are particularly useful with diamond bits because of the close proximity of the nozzles to the cutting surface in diamond bits which results in a very high wear rate.

22 Claims, 14 Drawing Figures

FIG. 1
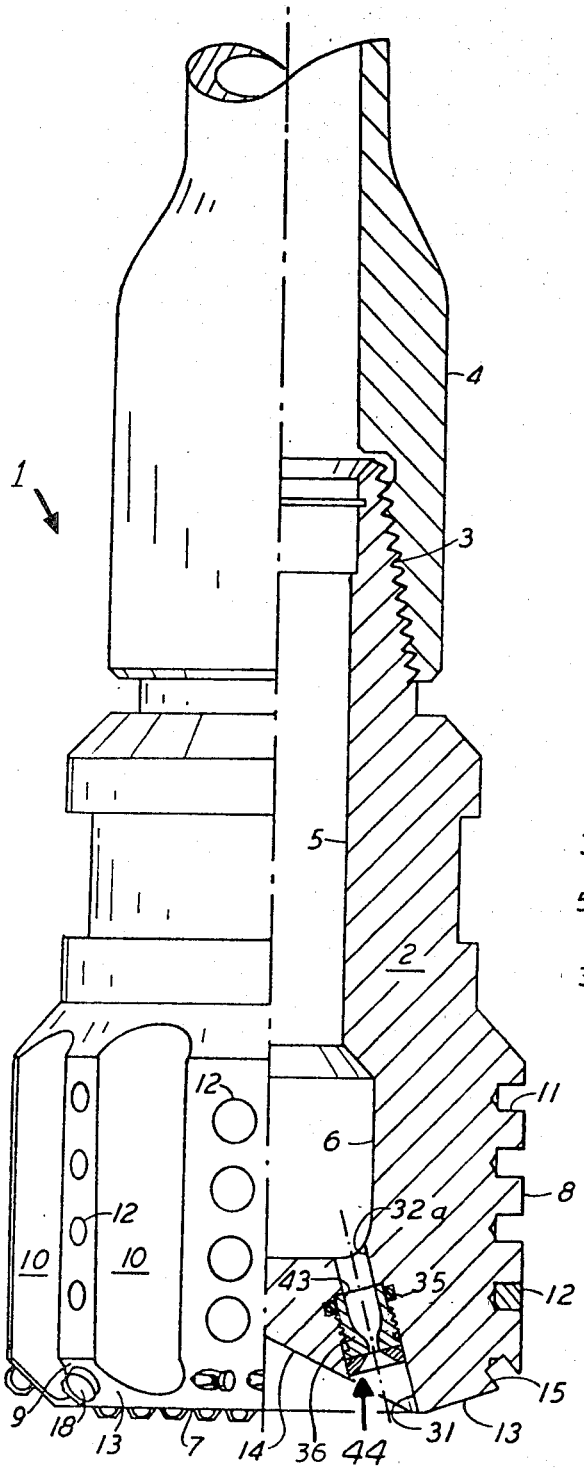
FIG. 3
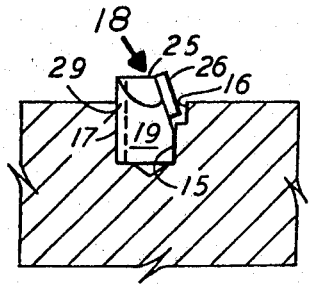
FIG. 4
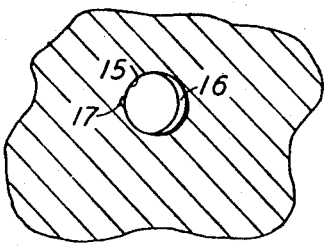
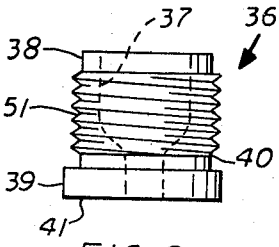
FIG. 8
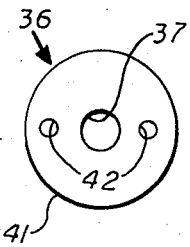
FIG. 9
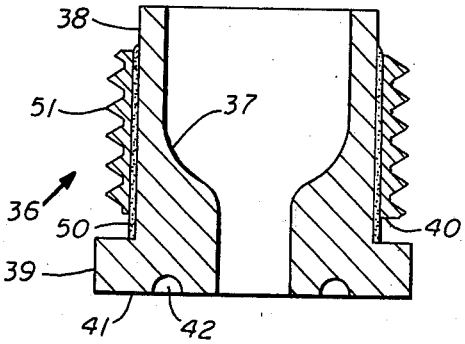
FIG. 8A

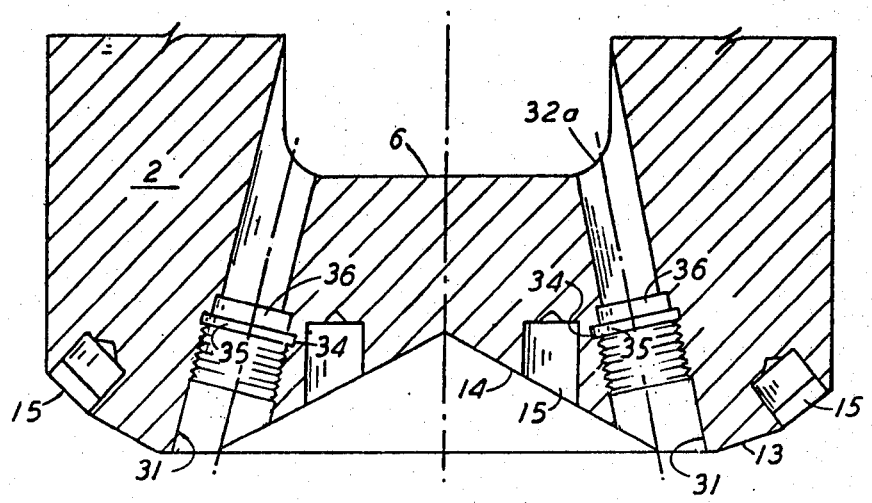
FIG. 10
FIG. 11
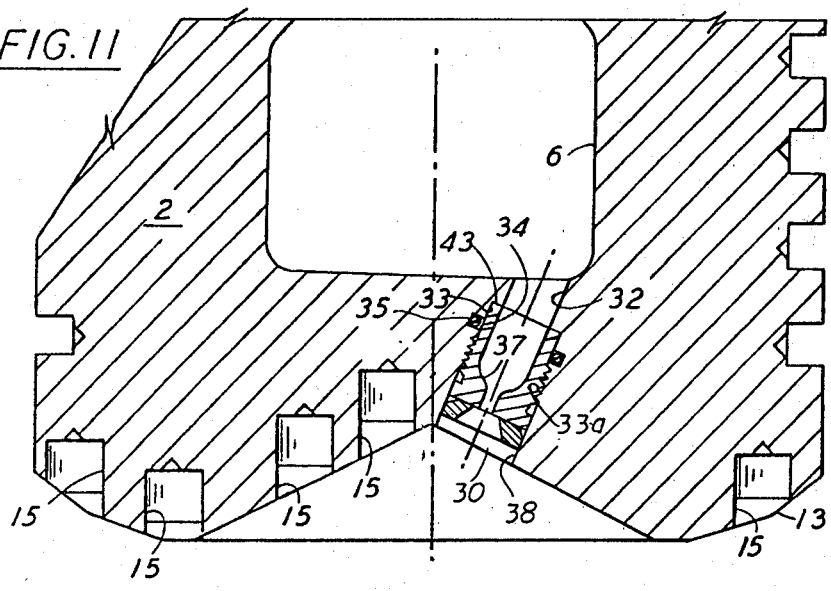
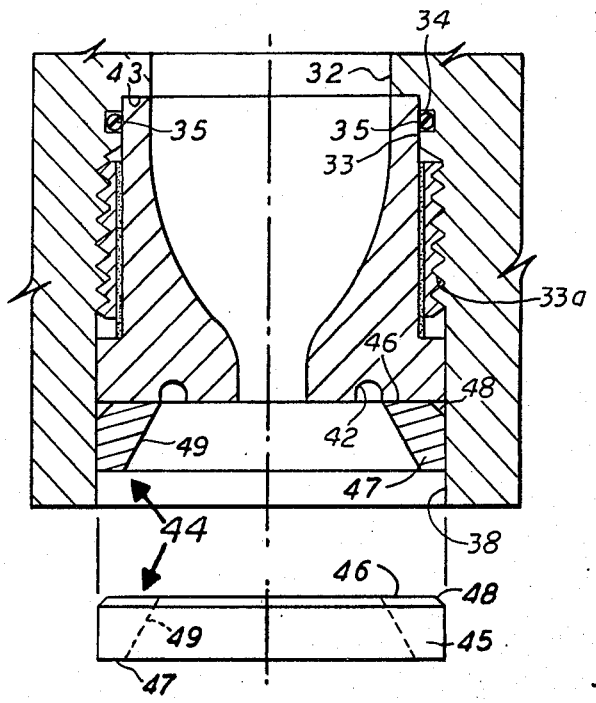
FIG. 12

DRILL BIT NOZZLE

BACKGROUND OF THE INVENTION

1. FIELD OF THE INVENTION

This invention relates to new and useful improvements in drill bits and more particularly to drill bits having replaceable nozzles and improved retaining means therefor.

2. BRIEF DESCRIPTION OF THE PRIOR ART

Rotary drill bits used in earth drilling are primarily of two major types. One major type of drill bit is the roller cone bit having three legs depending from a bit body which support three roller cones carrying tungsten carbide teeth for cutting rock and other earth formations. Another major type of rotary drill bit is the diamond bit which has fixed teeth of industrial diamonds supported on the drill body or on metallic or carbide studs or slugs anchored in the drill body.

It is well known in both types of drill bit to provide nozzle passages for circulating drilling fluid from the interior of the drill bit in a jet toward the point where the cutters engage the bottom of the hole. In roller cone type bits there has been a substantial amount of activity, mostly in the 1950s and 60s, in the development of removable nozzles. In diamond type drill bits, most bit bodies have been provided with fixed nozzle passages. Removable nozzles have been difficult to apply to diamond drill bits because of the proximity of the nozzle to the cutting surface which results in a very rapid erosion of the snap ring retainers for the nozzle members.

Replaceable nozzles have been developed in the past. These nozzles have been retained in a fluid discharge bore in the bit body by abutting their upper ends against shoulders in the bore and then inserting snap rings into grooves at the lower end of the nozzle. The drilling fluid is very abrasive and the exposure of the snap rings as well as the bit body at the lower end of the nozzle adjacent to the snap ring groove to the wash of the drilling fluid has caused this snap ring as well as the body portion supporting it to erode and fail, permitting the nozzle to be lost into the bottom of the hole.

This structural arrangement, wherein the snap ring and its support are continually exposed to drilling fluid, together with the fact that higher drilling fluid jet velocities and consequently high pressure differentials across the nozzle are being used, combined to make the snap ring somewhat unsatisfactory in many cases for retaining nozzles in the bit body. A variety of patents have been granted on arrangements which attempt to solve this problem in roller cone bits.

Payne U.S. Pat. No. 2,855,182 discloses a replaceable nozzle for a roller cone type bit which is provided with a peripheral sealing ring and is held in place by a snap ring adjacent the discharge end of the nozzle.

Sease U.S. Pat. No. RE. 25,452 (of 2,868,512) discloses a nozzle which is substantially the same as that shown in Payne but provided with a rubber sealing ring protecting the end of the nozzle against abrasion.

Scarborough U.S. Pat. No. 3,084,751 discloses a roller cone bit having replaceable nozzles secured in position by retaining pins located away from the abrasive environment at the end of the nozzle. This structure is somewhat difficult to manufacture.

Steen U.S. Pat. No. 3,096,834 discloses a replaceable jet nozzle for rock bits having a rubber shield at the lower face of a metal retainer ring.

Mandrell U.S. Pat. No. 3,115,200 discloses a removable nozzle for a drill bit having an improved arrangement for accessibility of a snap ring for retaining the nozzle in place.

Crawford U.S. Pat. No. 3,137,354 discloses removable drill bit nozzles secured in place by set screws.

Neilson U.S. Pat. No. 3,207,241 discloses removable drill bit nozzles secured in place by threaded retaining sleeves.

The copending application Ser. No. 220,306, filed Dec. 29, 1980, discloses an improved arrangement for securing replaceable nozzles in drilling bits by means of a metal or hard metal retaining ring.

There are several types of diamond bits known to the drilling industry. In one type, the diamonds are a very small size and randomly distributed in a supporting matrix. Another type contains diamonds of a larger size positioned on the surface of a drill shank in a predetermined pattern. Still another type involves the use of a cutter formed of a polycrystalline diamond supported on a sintered carbide support.

Some of the most recent publications dealing with diamond bits of advanced design, relavent to this invention, consists of Rowley, et al. U.S. Pat. No. 4,073,354 and Rohde, et al. U.S. Pat. No. 4,098,363. An example of cutting inserts using polycrystalline diamond cutters and an illustration of a drill bit using such cutters, is found in Daniels, et al. U.S. Pat. No. 4,156,329.

The most comprehensive treatment of this subject in the literature is probably the chapter entitled STRATAPAX bits, pages 541–591 in ADVANCED DRILLING TECHNIQUES, by William C. Maurer, The Petroleum Publishing Company, 1421 South Sheridan Road, P. O. Box 1260, Tulsa, Okla., 74101, published in 1980. This reference illustrates and discusses in detail the development of the STRATAPAX diamond cutting elements by General Electric and gives several examples of commercial drill bits and prototypes using such cutting elements.

These patents and the cited literature show the construction of various diamond bits and related prior art but do not consider the problem of nozzle retention in diamond bits adjacent to the cutting surface of the bit.

SUMMARY OF THE INVENTION

One of the objects of this invention is to provide a new and improved drill bit having removable and replaceable nozzles with an improved nozzle retaining means.

Another object is to provide a drill bit having removable and replaceable nozzles secured in threaded fluid passages or bores in the drill body by male threads on a metal sleeve brazed (or otherwise secured) on the nozzles.

Another object is to provide a drill bit having removable and replaceable nozzles secured in threaded fluid passages or bores in the drill body by male threads on a metal sleeve brazed (or otherwise secured) on the nozzles, the nozzles being protected against unscrewing by a metal or hard metal retaining ring positioned against the nozzle and secured in place by an interference fit.

Another object is to provide an improved drill bit having diamond cutters supported on the drill body and having threaded nozzle passages opening through the cutting face of the body with removable and replaceable nozzle members positioned therein and secured in place by male threads on a metal sleeve brazed (or otherwise secured) on the nozzles.

Another object is to provide an improved drill bit having diamond cutters supported on the drill body and having threaded nozzle passages opening through the cutting face of the body with removable and replaceable nozzle members positioned therein and secured in place by male threads on a metal sleeve brazed (or otherwise secured) on the nozzles, the nozzles being protected against unscrewing by an annular retaining ring of metal or hard metal secured therein by an interference fit.

Other objects and features of this invention will become apparent from time to time throughout the specification and claims as hereinafter related.

The foregoing objectives are accomplished by a new and improved drill bit with removable nozzles as described herein. A drill bit for connection on a drill string has a hollow tubular body with an end cutting face and an exterior peripheral stabilizer surface with cylindrical sintered carbide inserts positioned therein and a novel arrangement for securing replaceable nozzles.

Nozzle passages extend from the interior of the bit body through the cutting face for receiving a removable and interchangeable nozzle member therein. A portion of the length of each passage is threaded and the remainder of the passage is enlarged and of a smooth bore. The nozzle member is formed of hard metal, e.g. carbide, and has a metal sleeve brazed (or otherwise secured) thereon with male threads operable to be fitted in the threads in said nozzle passage. The nozzle member is threadedly secured in place during installation and can be further secured against unscrewing and protected against wear or erosion by a metal or hard metal, e.g. carbide, oxide, boride, nitride, or silicide retaining ring having an interference fit in the smooth portion of the nozzle passage.

The cutting face preferably has a plurality of recesses therein which receive, by an interference fit, a plurality of cutting elements of the type known as STRATAPAX, consisting of a cylindrical stud having an angular supporting surface with a cutting disc bonded thereon consisting of sintered carbide having a cutting surface of polycrystalline diamond. The replaceable nozzles with threaded exteriors and protecting retaining rings may be used with other types of drill bits, e.g. roller cone bits, but are particularly useful with diamond bits because of the close proximity of the nozzles to the cutting surface in diamond bits which results in a very high wear rate.

BRIEF DESCRIPTION OF THE DRAWINGS

FIG. 1 is a view partly in elevation and partly in quarter section of an earth boring drill bit with diamond-containing cutting inserts incorporating a preferred embodiment of this invention and showing the threaded replaceable nozzle and nozzle retaining ring.

FIG. 3 is a sectional view taken normal to the surface of the drill bit through one of the recesses in which the cutting inserts are positioned and showing the insert in elevation.

FIG. 4 is a sectional view in plan showing the hole or recess in which the cutting insert is positioned.

FIG. 8 is a view in elevation of one of the replaceable nozzle members.

FIG. 8A is a view in central section, slightly enlarged, of the nozzle member shown in FIG. 8.

FIG. 9 is an end view of the nozzle member shown in FIGS. 8 and 8A.

FIG. 10 is a view in section taken on the line 10—10 of FIG. 2.

FIG. 11 is a sectional view taken on the line 11—11 of FIG. 2.

FIG. 12 is a detail, enlarged sectional view of the removable and replaceable nozzle member shown in FIGS. 1 and 11 with the retaining ring shown in a partially exploded relation.

DESCRIPTION OF THE PREFERRED EMBODIMENTS

Figure 2:
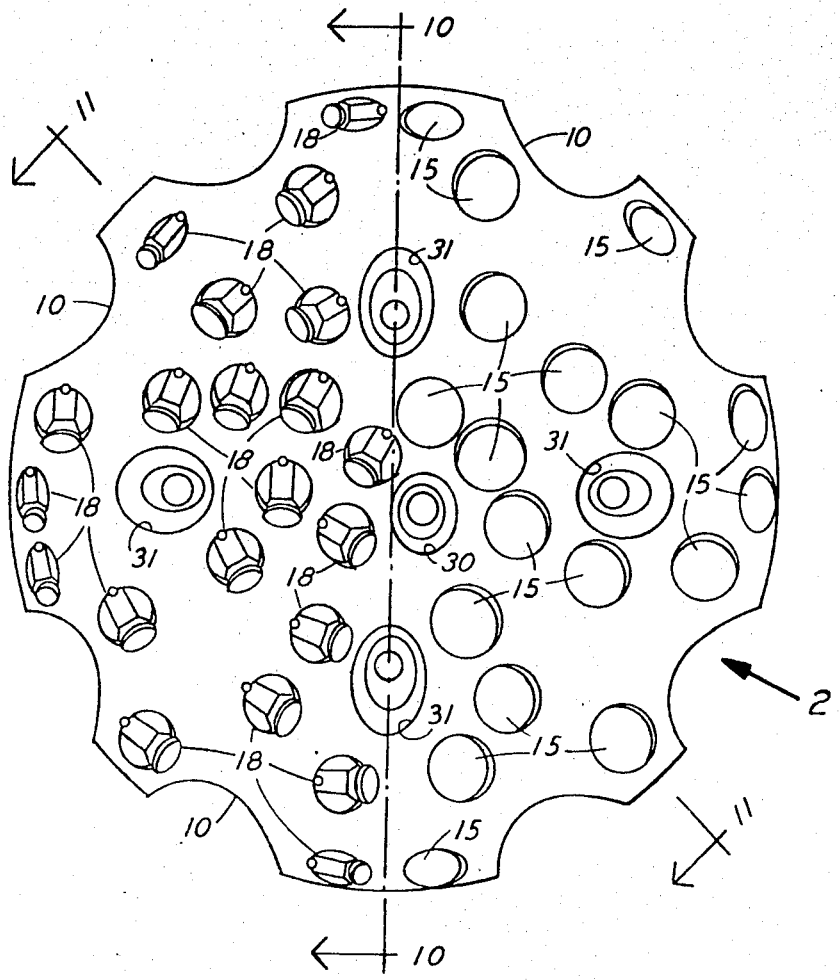
FIG. 2 is a plan view of the bottom of the drill bit shown in FIG. 1 showing half of the bit with cutting inserts in place and half without the inserts, showing only the recesses, and also showing the nozzle retaining rings in place.
Figure 6:
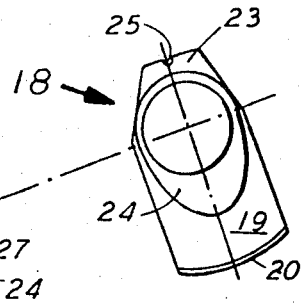
FIG. 6 is a view of one of the cutting inserts in plan relative to the surface on which the cutting element is mounted.

Referring to the drawings by numerals of reference and more particularly to FIG. 1, there is shown a drill bit 1 having replaceable drilling nozzles held in place by a threaded arrangement comprising a preferred embodiment of this invention. The threaded arrangement for securing nozzles may be used in other types of drill bits but is particularly useful in this bit because of the close proximity of the nozzles to the cutting surface of the bit and the bottom of the drill hole which results in a very high rate of wear.

The particular drill bit shown includes many features found in a drill bit described in the copending U.S. patent application of Mahlon Dennis, Ser. No. 158,389, filed June 11, 1980 and applicant's copending application Ser. No. 220,306, filed Dec. 29, 1980 (which discloses an improved arrangement for securing replaceable nozzles in drilling bits by means of a metal or hard metal retaining ring).

Drill bit 1 comprises a tubular body 2 which is adapted to be connected as by a threaded connection 3 to a drill collar 4 in a conventional drill string. The body 2 of drill bit 1 has a longitudinally extending passage 5 terminating in a cavity 6 formed by end wall 7 which is the cutting face of the drill bit.

Drill bit 1 has a peripheral stabilizer surface 8 which meets the cutting face 7 at the gage cutting edge portion 9. The stabilizer portion 8 is provided with a plurality of grooves or courses 10 which provide for flow of drilling mud or other drilling fluid around the bit during drilling operation. The stabilizer surface 8 is provided with a plurality of cylindrical holes or recesses 11 in which are positioned hard metal inserts 12. The hard metal inserts 12 are preferably by a sintered carbide and are cylindrical in shape and held in place in recesses 11 by an interference fit with the flat end of the insert being substantially flush with the stabilizer surface 8.

The cutting surface or cutting face 7 of the drill bit body 2 is preferably a crown surface defined by the intersection of outer conical surface 13 and inner negative conical surface 14. The crown surfaces 13 and 14 are provided with a plurality of sockets or recesses 15 spaced therearound in a selected pattern. As will be seen from the bottom plan view in FIG. 2, the sockets or recesses 15 and the cutting inserts which are positioned therein are arranged in substantially a spiral pattern. In FIGS. 3 and 4, the sockets or recesses 15 are shown in more detail with the cutting inserts being illustrated.

Each of the recesses 15 is provided with a counterbore 16 extending for only part of the depth of the recess 15. There is also provided a smaller diameter cylindrical recess 17 which intersects the wall of recess 15 and is open thereto. Recess 17 functions to receive a retaining pin as will be subsequently described. The recesses 15 in crown faces 13 and 14 receive a plurality of cutting elements 18 which are seen in FIGS. 1 and 2 and are shown in substantial detail in FIGS. 3, 5, 6 and 7.

Cutting elements 18 are preferably STRATAPAX cutters manufactured by General Electric Company and described in Daniels, et al. U.S. Pat. No. 4,156,329, Rowley, et al. U.S. Pat. No. 4,073,354 and in considerable detail in ADVANCED DRILLING TECHNIQUES by William C. Maurer. The STRATAPAX cutting elements 18 consist of a cylindrical supporting stud 19 of sintered carbide. Stud 19 is beveled at the bottom as indicated at 20, has edge tapered surfaces 21 and 22, a top tapered surface 23 and an angularly oriented supporting surface 24.

Figure 5:
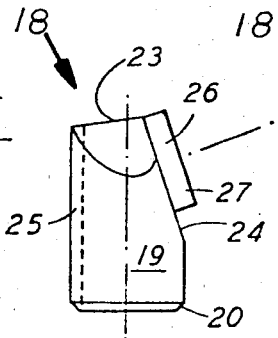
FIG. 5 is a view in side elevation of one of the cutting inserts.
Figure 5A:
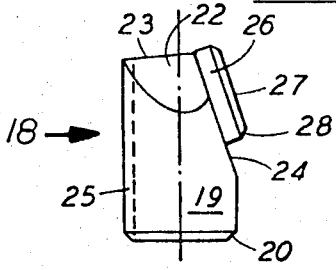
FIG. 5A is a view in side elevation of an alternate embodiment of one of the cutting inserts.
Figure 7:
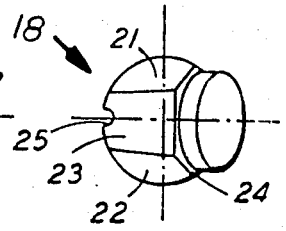
FIG. 7 is a top view of the cutting insert shown in FIG. 5.

A small cylindrical groove 25 is provided along one side of supporting stud 19. A disc shaped cutting element 26 is bonded on angular supporting surface 24, preferably by brazing or the like. Disc shaped cutting element 26 is a sintered carbide disc having a cutting surface 27 comprising polycrystalline diamond. In FIG. 5A, there is shown an alternate form of cutting element 18 in which the cutting surface 27 of polycrystalline diamond on disc shaped cutter 26 is beveled around the peripheral edge as indicated at 28.

The relative size of supporting studs 19 of cutting elements 18 and the diameter of recesses 15 are selected so that cutting elements 18 will have a tight interference fit in the recesses 15. The recesses 15 are oriented so that when the cutting elements are properly positioned therein the disc shaped diamond faced cutters 26 will be positioned with the cutting surfaces facing the direction of rotation of the drill bit. When the cutting elements 18 are properly positioned in sockets or recesses 15 the groove 25 in supporting stud 19 is aligned with the small half cylindrical recess 17 on the edge of socket or recess 15.

Half cylindrical recess 17 and cylindrical groove 25 in supporting stud 19 together form a cylindrical cavity in which there is positioned a retaining pin 29. Retaining pin 29 is a metal pin of sufficient size that it is retained in the cavity between the groove 25 and recess 17 by an interference fit. This further assists in holding cutting element 18 tightly in the cutting face of the drill bit and prevents rotation or twisting of the cutting element during cutting operation.

In FIG. 3, the retaining pin 29 is shown as a relatively short pin terminating flush with the surface of the cutting face in which the cutting element is imbedded. The recess 17 in which pin 29 is inserted is shown as extending only about half the depth of recess 15. This is one preferred arrangement although recess 17 can be extended for the entire depth of recess 15 if desired or the use of the retaining pin can be eliminated and the interference fit alone used to secure the supporting stud 19 in place and against rotation.

Drill bit body 2 is provided with a centrally located nozzle passage 30 and a plurality of equally spaced nozzle passages 31 toward the outer part of the bit body. The nozzle passages 30 and 31 are designed to provide for the flow of drilling fluid, i.e. drilling mud or the like, to keep the bit clear of rock particles and debris as it is operated.

The outer nozzle passages 31 are preferably positioned in an outward angle of about 10°–25° relative to the longitudinal axis of the bit body. The central nozzle passage 30 is preferably set at an angle of about 30° relative to the longitudinal axis of the bit body. The outward angle of nozzle passages 31 directs the flow of drilling fluid toward the outside of the bore hole and preferably ejects the drilling fluid at about the peak surface of the crown surface on which the cutting inserts are mounted.

This arrangement of nozzle passages and nozzles provides a superior cleaning action for removal of rock particles and debris from the cutting area when the drill bit is being operated. The proximity of the nozzles to the cutting surface, however, causes a problem of excessive wear which has been difficult to overcome. The erosive effect of rock particles at the cutting surface tends to erode the lower end surface of the bit body and also tends to erode the metal surrounding the nozzle passages. In the past, snap rings have usually been used to hold nozzles in place and these are eroded rapidly during drilling with annoying losses of nozzles in the hole.

The central nozzle passage 30 comprises passage 32 extending from drill body cavity 6 and has a counterbore 33 cut therein providing a shoulder 43. Counterbore 33 is provided with a peripheral groove 34 in which there is positioned an O-ring 35. Counterbore 33 is internally threaded as indicated at **33*a* and opens into an enlarged smooth bore portion 38** which opens through the lower end portion or face of the drill bit body.

A nozzle member 36 is threadedly secured in counterbore 33 against shoulder 43 and has a passage 37 providing a nozzle for discharge of drilling fluid. Nozzle member 36 is a removable and interchangeable member which may be removed for servicing or replacement or for interchange with a nozzle of a different size or shape, as desired.

Nozzle member 36 has its main portion formed of a hard metal, e.g. carbide or the like, with a smooth cylindrical exterior 38 and an end flange 39. Since hard metal is substantially unmachinable, it is virtually impossible to form threads in the nozzle member. A steel (or other suitable metal) sleeve 40 is brazed (or otherwise secured) to cylindrical nozzle portion 38 as indicated at 50 and has male threads 51 sized to be threadedly secured in the female threaded portion **33*a* of nozzle counterbore 33**.

As seen in FIGS. 8, and 8A and 9, the end face 41 of nozzle member 36 has recesses or indentations 42 formed therein which provide for insertion of a suitable wrench or tool forturning the nozzle member 36 to screw or unscrew the same for installation or removal. The peripheral surface of nozzle flange 39 fits the enlarged bore 38 of the nozzle-containing passage so that the nozzle member 36 can be threadedly installed in the position shown, with its end abutting shoulder 43. The face 41 of flange 39 shields the metal of threads 51 from abrasive wear or erosion.

The threaded arrangement for securing nozzle members 36 in place avoids the problem encountered when snap rings are used for retention, viz. erosive wear and breakage of the snap rings with loss of nozzles in the bottom of the boreholes. There is a further problem, however, with the threaded connection in that the nozzle may become unscrewed during use and lost in the hole.

This problem can be overcome by use of locking type screw threads but such an arrangement has the disadvantage of making removal and replacement of the nozzles more difficult. Another arrangement for solving this problem is for the apparatus to be provided with a retaining ring 44 which protects the nozzle member 36 and the enlarged bore portion 38 against wear and prevents the nozzles from unscrewing and becoming lost downhole.

In FIG. 10, the nozzle passages 31 are shown in some detail with the nozzle member 36 in place but without the retaining ring 44. In the nozzle passages 31, each nozzle passage 32*a* opens from body cavity 6 and is intersected by counterbore 33*a*. In FIG. 10, nozzle member 36 is shown unsectioned so that only the exterior cylindrical surface is seen. O-ring 35 is seen in full elevation surrounding the cylindrical surface 38 of nozzle member 36 and extending into peripheral groove 34.

There is a considerable advantage to the use of nozzle members threadedly secured as shown in FIGS. 10–12 and particularly extending at the angles described. In FIGS. 11 and 12, the retaining rings 44 are shown in more detail. These rings are press fitted in place and secure the nozzle members 36 against loss by unscrewing. Rings 44 also provide protection to the end of the nozle members and to the metal of the bit body surrounding the enlarged bore portion 38. In FIG. 12, nozzle member 36 is shown positioned in place against shoulder 43 with the O-ring 35 providing the desired seal against leakage. In this view, retaining ring 44 is shown both in place and in exploded relation.

Retaining ring 44 is an annular ring having a cylindrical outer surface 45 and flat end surfaces 46 and 47. A peripheral bevel 48 is provided at the intersection of outer surface 45 and end face 46. The inner opening 49 is of adequate size to permit unobstructed flow of drilling fluid from nozzle passage 37. Opening 49 may be cylindrical or any other desired configuration, but is preferably a conical surface, as shown, flaring outward toward the end of passage 31 opening through the cutting face 7 of bit body 2. Retaining ring 44 has its outer surface 45 very slightly larger than the inner surface or bore of passage 31 and has an interference fit therein. The bevel 48 on retaining ring 44 permits the ring to be pressed into the slightly smaller bore of passage 31 without cutting or scoring the bit body. The retaining ring 44 is preferably oversize by about 0.002–0.004 inch in relation to the bore of passage 31.

Retaining ring 44 is preferably of a hardened steel or a hard metal, such as sintered tungsten carbide. Retaining rings 44 may be used in the retention of all of the nozzle members 36 against unscrewing. Retaining rings 44 hold nozzles members 36 tightly in place to prevent unscrewing and to protect against erosion or wear during use. Retaining rings 44 can be drilled out or removed by suitably designed tools for exchange or replacement of the nozzle members 36 in the field.

OPERATION

The operation of this drill bit should be apparent from the foregoing description of its component parts and method of assembly. Nevertheless, it is useful to restate the operating characteristics of this novel drill bit to make its novel features and advantages clear and understandable.

The drill bit as shown in the drawings and described above is primarily a rotary bit of the type having fixed diamond surfaced cutting inserts. Most of the features described relate only to the construction of a diamond bit. The use of retaining rings 44 and the threaded, replaceable nozzle members 36, as shown in FIGS. 1, 11, and 12, is of more general application.

This arrangement for retention of the removable and interchangeable nozzle members is useful in a diamond bit as described and shown herein but would also be of like use in providing for the retention of removable and interchangeable nozzle member in roller bits, particularly when equipped with extended nozzles, or any other bits which have a flow of drilling fluid through the bit body and out through a flow directing nozzle. The threaded arrangement for releasably securing the nozzle members in place is therefore considered to be of general application and not specifically restricted to the retention of nozzles in diamond cutter insert type bits.

In operation, this drill bit is rotated by a drill string through the connection by means of the drill collar 4 shown in FIG. 1. Diamond surfaced cutting elements 18 cut into the rock or other earth formations as the bit is rotated and the rock particles and other debris is continuously flushed by drilling fluid, e.g. drilling mud, which flows through the drill string and the interior passage 5 of the drill bit and is ejected through nozzle passages 30 and 31 as previously described.

The central nozzle 30 is set at an angle of about 30° to flush away cuttings and debris from the inside of the cutting crown. The outer nozzle passages 31 are set at an angle of 10°–25° outward relative to the longitudinal axis of the drill bit body. These nozzle passages emerge through the cutting face at about the peak of the crown cutting surface. This causes the drilling fluid to be ejected toward the edges of the bore hole and assists in flushing rock particles and cuttings and debris away from the cutting surface. As noted above in the description of contruction and assembly, the nozzle passages 30 and 31 are formed by removable nozzle members 36 which are held in place by threads 51 in sleeve 40 and secured against unscrewing by retaining rings 44 secured by an interference fit.

The peripheral surface or stabilizer surface 8 of drill bit body 2 is provided with a plurality of sintered carbide cylindrical inserts 12 positioned in sockets or recesses 11 thereof. These inserts protect stabilizer surface 8 against excessive wear and assist in keeping the bore hole to proper gage to prevent the drill bit from binding in the hole. The grooves or courses 10 in stabilizer surface 8 provide for circulation of drilling fluid, i.e. drilling mud, past the drill bit body 2 to remove rock cuttings and debris to the surface.

As previously pointed out, the construction and arrangement of the cutting elements and the method of assembly and retention of these elements is especially important to the operation of this drill bit. The drill bit is designed to cut through very hard rock and is subjected to very substantial stresses. Typical cutting elements 18 are STRATAPAX cutting elements manufactured by General Electric Company and consist of diamond surfaced cutting discs supported on carbide studs as described above. The counterbore 16 adjacent to the socket or recess 15 in which cutting element stud 19 is fitted allows for cutting disc 26 to be partially recessed below the surface of the cutting face of the drill bit and also provides for relieving the stress on the drill bit during the cutting operation.

The optional use of retaining pin 29, which is inserted into the cavity defined by passage 17 and groove 25 provides a further interference fit assisting in retaining cutting element 18 in position and protecting it against twisting movement during cutting operation of the drill bit. The arrangement of cutting elements 18 in a spiral pattern on the crown cutting surface, as shown in FIG. 2, provides for a uniform cutting action on the bottom of the bore hole. The cutters 18 which lie on the outer conical cutting surface 15 function to cut the gage of the bore hole and these cutters together with the carbide inserts 12 in the stabilizer surface 8 function to hold the side walls of the bore hole to proper gage and prevent binding of the drill bit in the bore hole.

While this invention has been described fully and completely with special emphasis upon a single preferred embodiment, it should be understood that within the scope of the appended claims the invention may be practiced otherwise than as specifically described herein.

I claim:

1. A drill bit with replaceable nozzles comprising a drill body having a hollow tubular body adapted to be connected to a drill string, said drill body having an exterior peripheral stabilizer surface and an end cutting face, a plurality of cutting elements supported in cutting position in said cutting face, at least one nozzle passage in said drill body comprising a passage opening from the interior of said body and a first counterbore aligned therewith to form a shoulder therein and internally threaded for at least a portion of its length and a second counterbore having a smooth cylindrical wall extending from said first counterbore and opening through said cutting face adjacent to said cutting elements, a removable nozzle member of abrasive resistant hard metal, having a cylindrical external surface, and an enlarged cylindrical end flange, said nozzle member cylindrical surface being of a size fitting inside said first counterbore and said cylindrical end flange fitting tightly in said second counterbore, a metal sleeve secured on said nozzle member cylindrical surface and having male threads formed therein sized to fit said first counterbore threaded portion, and said nozzle member being threadedly secured in said counterbore threaded portion with the end portion thereof fitting in said counterbore against said shoulder and said cylindrical end flange tightly fitted inside the end of said second counterbore to protect said threaded metal sleeve from abrasive wear.

2. A drill bit according to claim 1 in which said threaded sleeve is brazed on said cylindrical surface of said nozzle member.

3. A drill bit according to claim 2 in which said nozzle member has a flanged end portion shaped to receive a tool to turn the same for insertion or removal, and said flanged end portion shielding said metal sleeve threads against abrasive wear during use.

4. A drill bit according to claim 3 in which said flanged end portion has recesses or indentations in the end face thereof for receiving a tool.

5. A drill bit according to claim 2 in which said threaded sleeve is of steel.

6. A drill bit according to claim 1 including an annular metal or hard metal retaining ring having an exterior surface slightly larger than the unthreaded portion of said counterbore adjacent to said cutting surface and fitted in said counterbore by an interference fit against the end of said nozzle member to protect said nozzle member against unscrewing.

7. A drill bit according to claim 6 in which said retaining ring is of a hard steel.

8. A drill bit according to claim 6 in which said retaining ring is of hard metal.

9. A drill bit according to claim 6 in which said retaining ring has a cylindrical external surface, flat end surfaces, and an internal opening having a conical surface flaring outward toward the surface of said cutting face.

10. A drill bit according to claim 6 in which said retaining ring is recessed from the opening of said counterbore through said cutting face.

11. A drill bit according to claim 1, in which said drill body has a plurality of said passages and counterbores, and a plurality of said nozzle members positioned one in each of said counterbores.

12. A drill bit according to claim 1 in which said counterbore has an internal circumferential groove surrounding said nozzle member adjacent to said shoulder, and an elastomeric O-ring surrounding said nozzle member and positioned in said groove.

13. A drill bit according to claim 1 in which said cutting face comprises a crown surface defined by the intersection of an outer conical surface and an inner negative conical surface, and said counterbore opens through said crown surface.

14. A drill bit according to claim 1 in which said cutting face has a plurality of cylindrical recesses spaced therearound in a selected pattern, a plurality of cutting elements, one for each of said recesses, said cutting elements each comprising a cylindrical supporting stud of sintered carbide having an angularly oriented supporting surface wit a disc shaped element bonded thereon comprising a sintered carbide disc having a cutting surface comprising polycrystalline diamond, each of said cutting elements being positioned in one of said recesses by an interference fit, and said counterbore opening through said cutting face adjacent to selected ones of said cutting elements.

15. A drill bit with replaceable nozzles comprising a drill body having a hollow tubular body with an end wall at one end and adapted to be connected at the other end to a drill string, said drill body having cutter means supported thereon, at least one nozzle passage in said drill body comprising a passage opening from the interior of said body and a first counterbore aligned therewith to form a shoulder therein and internally threaded for at least a portion of its length and a second counterbore having a smooth cylindrical wall extending from said first counterbore and opening through said end wall adjacent to said cutter means, a removable nozzle member of abrasive resistant hard metal, having a cylindrical external surface, and an enlarged cylindrical end flange, said nozzle member cylindrical surface being of a size fitting inside said first counterbore and said cylindrical end flange fitting tightly in said second counterbore, a metal sleeve secured on said nozzle member cylindrical surface and having male threads formed therein sized to fit said first counterbore threaded portion, and said nozzle member being threadedly secured in said counterbore threaded portion with the end portion thereof fitting in said counterbore against said shoulder and said cylindrical end flange tightly fitted inside the end of said second counterbore to protect said threaded metal sleeve from abrasive wear.

16. A drill bit according to claim 15 including additionally an annular metal or hard metal retaining ring having an exterior surface slightly larger than said counterbore and fitted in said counterbore by an interference fit against the end of said nozzle member to retain said nozzle member in position and protect it against unscrewing.

17. A removable nozzle member for use in earth drilling bits or other tools, comprising a body portion formed of hard metal, selected from the group consisting of metal carbides, oxides, borides, nitrides and silicides, having a cylindrical exterior surface and an internal nozzle shaped passage extending longitudinally thereof, a metal sleeve secured on said cylindrical surface and having male threads formed in the exterior surface thereof adapted to be secured in a threaded passage in a drill bit, and an enlarged cylindrical end flange at an end of said body portion away from said threaded sleeve, said threaded sleeve being adapted to be secured in a threaded opening in a metal body and said cylindrical flange being adapted to fit a counterbore in a metal body in sealing relation thereto and protecting said threaded sleeve portion against abrasive wear.

18. A nozzle member according to claim 17 in which said threaded sleeve is brazed on said cylindrical surface of said nozzle member.

19. A nozzle member according to claim 18 in which said nozzle member flanged end portion has an end surface shaped to receive a tool to turn the same for insertion or removal.

20. A nozzle member according to claim 19 in which said flanged end portion has recesses or indentations in the end face thereof for receiving a tool.

21. A nozzle member according to claim 18 in which said threaded sleeve is of steel.

22. An apparatus with a replaceable nozzle comprising a metal body having at least one nozzle passage therein comprising a passage opening therethrough and a first counterbore aligned therewith to form a shoulder therein and internally threaded for at least a portion of it length and a second counterbore having a smooth cylindrical wall extending from said first counterbore, a removable nozzle member of abrasive resistant hard metal, having a cylindrical external surface, and an enlarged cylindrical end flange, said nozzle member cylindrical surface being of a size fitting inside said first counterbore and said cylindrical end flange fitting tightly in said second counterbore, a metal sleeve secured on said nozzle member cylindrical surface and having male threads formed therein sized to fit said first counterbore threaded portion, and said nozzle member being threadedly secured in said counterbore threaded portion with the end portion thereof fitting in said counterbore against said shoulder and said cylindrical end flange tightly fitted inside the end of said second counterbore to protect said threaded metal sleeve from abrasive wear.

* * * * *

UNITED STATES PATENT AND TRADEMARK OFFICE

CERTIFICATE OF CORRECTION

PATENT NO. : 4,381,825

DATED : May 3, 1983

INVENTOR(S) : Robert P. Radtke

It is certified that error appears in the above-identified patent and that said Letters Patent is hereby corrected as shown below:

In the Cover page, Item No. 56, the Maurer et al. patent should be cited as follows:

---3,645,331 2/1972 Maurer et al. .....175/393---

After "Maurer et al." insert:

---4,265,324 5/1981 Morris et al. .....175/329---

Signed and Sealed this

Twelfth Day of June 1984

[SEAL]

*Attest:*

GERALD J. MOSSINGHOFF

*Attesting Officer*

*Commissioner of Patents and Trademarks*